US006319391B1

(12) United States Patent
Holderness et al.

(10) Patent No.: US 6,319,391 B1
(45) Date of Patent: Nov. 20, 2001

(54) REMOVAL OF METAL FROM GRAPHITE

(75) Inventors: Stewart Garfield Holderness, Preston; Robert Glyn Lewin, Bury, both of (GB)

(73) Assignee: British Nuclear Fuels, Cheshire (GB)

( * ) Notice: Subject to any disclaimer, the term of this patent is extended or adjusted under 35 U.S.C. 154(b) by 0 days.

(21) Appl. No.: 08/405,372

(22) Filed: Mar. 15, 1995

Related U.S. Application Data

(63) Continuation of application No. 08/105,840, filed on Aug. 13, 1993, now abandoned.

(30) Foreign Application Priority Data

Aug. 15, 1992 (GB) ..... 9217414

(51) Int. Cl.[7] ..... C25F 1/00
(52) U.S. Cl. ..... 205/768; 205/771; 205/772
(58) Field of Search ..... 205/768, 771, 205/772

(56) References Cited

U.S. PATENT DOCUMENTS

| | | | | |
|---|---|---|---|---|
| 429,386 | * | 6/1890 | Parrish | 204/130 |
| 1,314,632 | * | 9/1919 | Bullock | 204/130 |
| 1,378,834 | * | 5/1921 | Bullock | 204/130 |
| 1,600,730 | * | 9/1926 | Haffner | 204/130 |
| 2,903,402 | * | 9/1959 | Fromm, Jr. | 204/1.5 |
| 4,349,423 | | 9/1982 | Nützel | 204/146 |
| 4,385,972 | | 5/1983 | Janderpool | 204/146 |
| 4,775,452 | | 10/1988 | Kuninaga et al. | 204/146 |

FOREIGN PATENT DOCUMENTS

| | | |
|---|---|---|
| 0 221 187 | 5/1987 | (EP) . |
| 497 835 | 12/1938 | (GB) . |
| 1273170 | 5/1972 | (GB) . |
| 61-201165 | 9/1986 | (JP) . |
| 3-216599 | 9/1991 | (JP) . |

OTHER PUBLICATIONS

Palamalai et al., "Development of an Electro–Oxidative Dissolution Technique for Fast Reactor Carbite Fuels" (1991) (Abstract Only).

* cited by examiner

*Primary Examiner*—Arun S. Phasge
(74) *Attorney, Agent, or Firm*—Nixon & Vanderhye

(57) ABSTRACT

A method of treating scrap graphite having a metal contaminant adhered thereto. The metal is separated from the graphite by placing the scrap graphite in an aqueous oxidizing electrolyte and passing there through an electric current. The electric current may be directional. The metal may be uranium and the scrap graphite may be from the casting of uranium fuel rods. The graphite body disintegrates in the electrolyte and the metal dissolves at an accelerated rate under the influence of the electric current. The metal can also break off from the graphite and may dissolve over a longer time period in the electrolyte. The graphite so treated may be separated from the electrolyte by filtering and washing. Where the graphite has been contaminated with uranium the separation by this process is sufficient to allow the graphite to be disposed of in a conventional manner rather than special means required for hazardous, radioactive materials.

14 Claims, 2 Drawing Sheets

REMOVAL OF METAL FROM GRAPHITE

This is a continuation of application Ser. No. 08/105,840, filed Aug. 13, 1993, now abandoned.

The present invention relates to the removal of metal from graphite and in particular to the decontamination of graphite bodies coated with metallic uranium or other actinides or actinide-containing materials.

BACKGROUND OF THE INVENTION

Graphite is used in large quantities in the casting of metallic articles, especially uranium fuel rods for nuclear reactors. In such use the graphite becomes contaminated with the metal being cast and is essentially scrap. It is necessary for the metal contaminant which typically forms no more than ten per cent by weight, eg 2 to 6 per cent by weight of the scrap, to be separated from the graphite so that the graphite can be safely disposed of. The metal may be recovered, and, where appropriate, re-used. One known method of separation comprises incinerating the graphite and collecting the metallic contaminant as ash. This method is expensive and it is harmful to the environment because of the large quantities of carbon dioxide produced.

DESCRIPTION OF THE INVENTION

According to the present invention a method of treating scrap graphite having a metal contaminant adhered thereto go as to separate the metal from the graphite comprises placing the scrap graphite in an aqueous oxidising electrolyte and passing through the electrolyte an electric current. The electric current may be a directional electric current.

The graphite body disintegrates in the electrolyte and the metal dissolves at an accelerated rate under the influence of the electric current. The metal can also break off from the graphite and may dissolve over a longer time period in the electrolyte. The graphite so treated may therefore be separated from the electrolyte eg by filtering and washing. Where the graphite has been contaminated with uranium the separation by this process is sufficiently successful to allow the graphite to be disposed of in a conventional manner rather than special means required for hazardous, radioactive materials.

The scrap graphite may contain less than 40 per cent, in most cases less than 10 per cent by weight, eg from 2 to 6 per cent by weight of contaminant metal so that the metal is a minor by product of the separation process (in terms of its quantity).

The electrolyte is desirably a strong acid, eg nitric and/or sulphuric acid. Its concentration is preferably in the range 5 to 70 per cent by weight of acid:aqueous solution. In general, the process works more rapidly as the concentration of the acid increases. The process speed also increases with the assistance of (a) an elevated electrolyte temperature, eg 30 to 80 degrees Celsius; also with (b) mechanical agitation or stirring of the electrolyte and also with (c) an increase in applied electric current or (d) input of additional energy from other sources, eg ultrasonic devices, or sparging.

The mean applied electric current needs to be greater than the minimum current required for the reaction, which is typically 10 milliamps per $cm^2$ but may be greater than 100 milliamp per $cm^2$.

Where mechanical stirring of the electrolyte in applied this may be by the use of a conventional paddle or agitator. Alternatively, ultrasonic stirring may be used.

The electrolytic system containing the electrolyte may comprise an acid bath into which the graphite is placed. The graphite may be contained in a basket, eg made of plastics material. One part of the basket, eg its upper body part (which resides out of the electrolyte), may be made of metallic material to act as an electrode conductor when the interconnected graphite pieces are immersed in the electrolyte. The conduction path is therefore from the metallic material through the graphite mass to the electrolyte. Alternatively, the current may be provided through one or more large solid blocks of graphite which are placed on top of the graphite stack and act as the said electrode conductor. Alternatively, or in addition, the positive electrode for applying electric current may be provided by a block of metal, eg stainless steel, in contact with the scrap graphite and/or by a collar of metal, eg stainless steel, inside the basket, eg slidably located against the inner wall thereof, in contact with the scrap graphite. The other electrode may be provided by a metallic, eg stainless steel, wire gauze positioned around the basket. Several baskets of graphite may be treated in this way together in the same bath.

The electrolyte employed in the bath may be circulated in and out of the bath in a known way. The used electrolyte containing graphite and dissolved metal may be filtered to remove the graphite and thereafter may be recycled for re-use. The concentration of the electrolyte may be maintained by distilling the acid or by sparging it with air. The process for supplying, extracting and treating electrolyte may be a continuous process or a batch process.

The electrolytically treated graphite may be washed and removed to a dump as non-hazardous waste.

The present invention provides an environmentally safer and cleaner method of separating metal, especially uranium, from graphite, prior to disposal of the graphite, than the method used in the prior art.

The method of the present invention may be applied to the separation of uranium from graphite employed to cast the uranium or alternatively to the separation of precious or semi-precious metals from graphite electrodes.

Electrolytic methods of separation of carbon from metals is known in the prior art, eg as described in prior patent specifications GB 497,835, GB 1,273,170, U.S. Pat. No. 4,385,972 and EP 0,221,187. However, in these references the carbon is not present as graphite, ie is either a minor impurity or is present as a compound, eg tungsten carbide. The object in these cases is to remove contaminant carbon to recover metals. In contrast, in the present invention the object is to remove contaminant metal from graphite, the contaminant metal forming only a small part of the material to be separated. The present invention provides a method of breaking down the carbon matrix and this problem is not faced or dealt with in the prior art. As noted above, the invention provides a more efficient, cost effective and environmentally friendly way of dealing with metal contaminated scrap graphite than the method conventionally used in the prior art described above and therefore beneficially and surprisingly provides a significant industrial advance in, for example, the nuclear industry where such scrap graphite is produced in large quantities.

BRIEF DESCRIPTION OF THE DRAWINGS

Embodiments of the present invention will now be described by way of example with reference to the accompanying drawing, in which.

Figure 1:
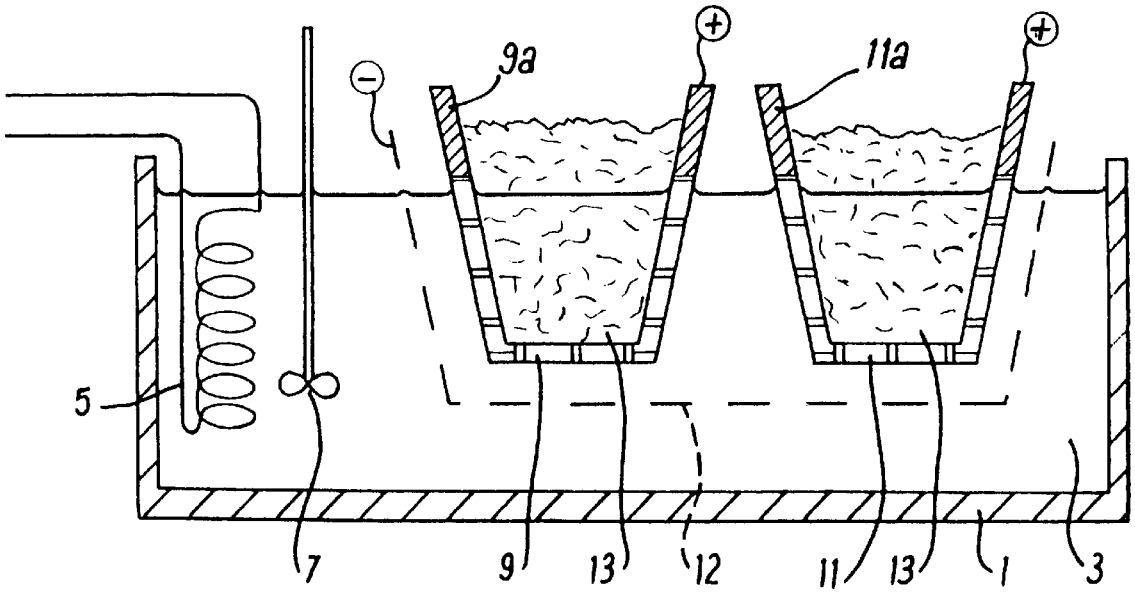
FIG. 1 is a cross-sectional front elevation of apparatus for carrying out a process for separating metal from graphite.

An shown in FIG. 1, a vessel 1 is made of stainless steel and has a plastics Insulation coating (not shown) which protects the stainless steel from damage by strong electrical currents developed in the apparatus in the manner to be described. The vessel 1 contains a bath of strong acid electrolyte solution which is maintained at a suitable operating temperature, eg in the range 20° C. to 60° C. by an electrically insulated heater coil 5. An external heat source (not shown) may be used instead. The bath 3 is periodically or continuously stirred by a stirrer 7. Baskets 9 and 11 made of polytetrafluoroethylene (PTFE) containing scrap 13 comprising metal contaminated graphite are immersed in the bath 3. The baskets 9 and 11 may have upwardly extending hoppers/collars 9*a,* 11*a* respectively made of stainless steel which form an anode or positive electrode connection—this is remote from the electrolyte to prevent corrosion and subsequent dissolution. A wire gauze 12 made of stainless steel encloses the baskets 9, 11 inside the bath 3. The gauze 12 forms a cathode or negative electrode. A direct electrical current is passed between the anode and the cathode through the electrolyte of the bath 3, the conduction path at the anode being via the collars 9*a,* 11*a* through the scrap 13 to the electrolyte bath 3. The scrap 13 is replenished from time to time to maintain the conduction path.

The graphite in the baskets 9, 11 disintegrates and falls through the holes in the baskets 9, 11. The metal contaminant on the graphite dissolves in the electrolyte of the bath 3. The electrolyte is removed (by means not shown) in one of the ways described above to separate the particulate graphite collected as a sediment therein from the metal contaminant dissolved therein.

Figure 2:
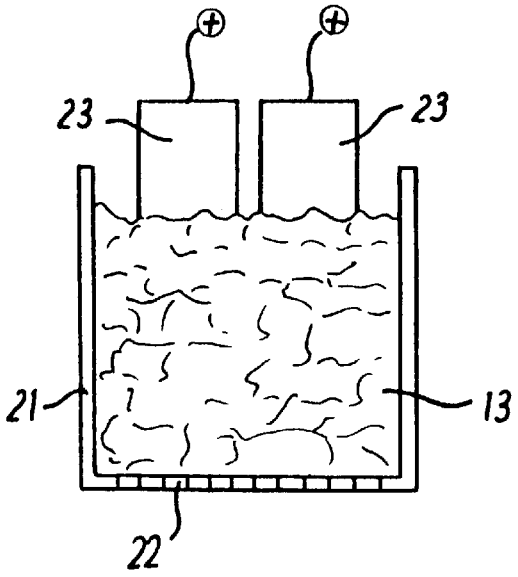
FIG. 2 is an alternative form of part of the apparatus shown in FIG. 1.

FIG. 2 shows an alternative container for the scrap 13 which may be used in place of the basket 9, 11 in the apparatus shown in FIG. 1. In FIG. 2, a container comprises a plastics basket 21 containing the scrap 13. The basket 21 has a grille base 22 and its sides may be either solid or perforated. Large, heavy solid blocks 23 of graphite are deposited on the upper surface of the scrap 13 and become embedded within the scrap near the upper surface thereof. In use, the blocks 23 form the positive electrode of the electrolytic cell and electric current is therefore introduced through the scrap 13 and the electrolyte bath 3 (FIG. 1) via the blocks 23.

Figure 3:
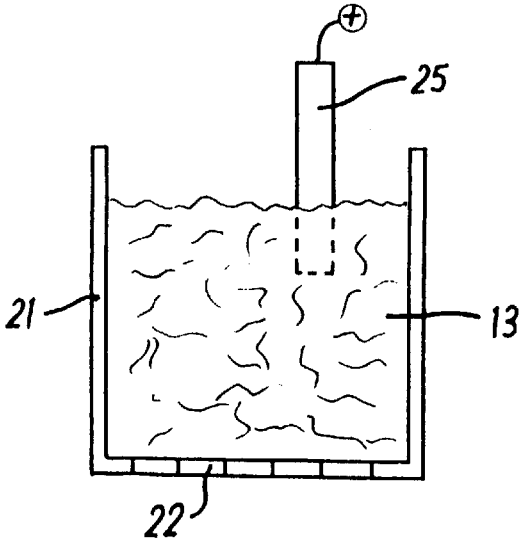
FIG. 3 is a further alternative form of part of the apparatus shown in FIG. 1.

FIG. 3 shows a further alternative arrangement for introduction of the electrical current. In this case, the basket 21 as in FIG. 2 is again charged with scrap 13 but the electrical current to the scrap 13 and electrolyte bath 3 (FIG. 1) is introduced via a solid metal block 25, eg made of stainless steel embedded in the top surface of the scrap 13 which acts as the positive electrode of the electrolytic cell.

Figure 4:
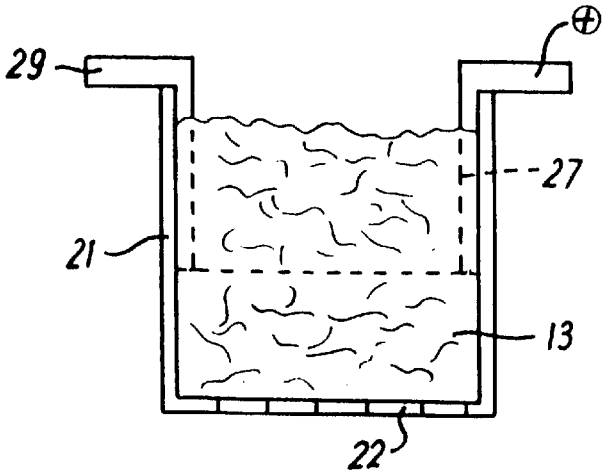
FIG. 4 is a still further alternative form of part of the apparatus shown in FIG. 1.

FIG. 4 shows a still further alternative arrangement for introduction of the electrical current through the scrap 13 and electrolyte bath 3. In this case, the basket 21 as in FIG. 2 is again charged with scrap 13 but the electrical current is introduced via a conducting metal collar 27 which fits inside the inner side wall of the basket 21 and thereby makes good contact with the scrap 13. The collar 27 has a lip 29 to facilitate making of an electrical connection so the collar 27 can act an a positive electrode for electrolytic cell.

The graphite blocks 23 (FIG. 2), the metal block (FIG. 3) and the metal collar 27 or any two of the three may be used in combination together.

What is claimed is:

1. A method of treating scrap graphite having a metal contaminant adhered thereto to separate the metal from the graphite, which method comprises the steps of:

(a) placing scrap graphite having a metal contaminant adhered thereto into a bath comprising an aqueous oxidizing electrolyte, the graphite being contained in one or more baskets having at least a base which has a grill or perforations to allow graphite particles to fall therethrough;

(b) applying to the scrap graphite an electric current contact whereby the graphite forms one electrode of an electrolytic cell;

(c) providing a second electrode in contact with the electrolyte; and (d) passing an electric current a round the electrical circuit comprising the electric current contact, the scrap graphite, the electrolyte and the second electrode thereby causing the scrap graphite to disintegrate and graphite particles to fall through the grill or perforations.

2. A method as in claim 1 wherein the scrap graphite in the bath is partially submerged in the electrolyte and is partially outside the electrolyte and the electric current contact is made to the scrap graphite outside the electrolyte.

3. A method as in claim 2 wherein an upper body part of the basket is made of metallic material and is outside the electrolyte and acts as said electric contact to interconnected pieces of graphite in the basket.

4. A method as in claim 3 wherein said electric contact is provided by a metal or graphite block in contact with the scrap graphite.

5. A method as in claim 4 wherein said electric contact is provided by a metal collar inside the basket in contact with the scrap graphite.

6. A method as in claim 2 wherein said second electrode is provided by a metallic wire gauze positioned around the basket or baskets.

7. A method as claimed in claim 2 wherein metal contaminated graphite contained in a plurality of the said baskets is treated together in the same bath.

8. A method as in claim 2 wherein the electrolyte employed in the bath is circulated in and out of the bath.

9. A method as in claim 2 wherein the metal constitutes not more than forty per cent by weight of the scrap.

10. A method as in claim 2 wherein the electric current is a directional electric current.

11. A method as in claim 2 wherein the electrolyte is a strong acid.

12. A method as in claim 2 wherein one or more of the following is applied to assist dissolution of the metal: (a) an elevated electrolyte temperature in the range 30 to 80° C.; (b) mechanical agitation or stirring of the electrolyte; or (c) input of additional energy from another source.

13. A method as in claim 2 wherein the mean applied electric current is greater than 10 milliamps per $cm^2$.

14. A method as in claim 2 wherein said metal comprises uranium or other actinide.

* * * * *